US007353951B2

(12) United States Patent
Vovan

(10) Patent No.: US 7,353,951 B2
(45) Date of Patent: Apr. 8, 2008

(54) EGG CONTAINER

(75) Inventor: Terry Vovan, Upland, CA (US)

(73) Assignee: PWP Industries, Vernon, CA (US)

( * ) Notice: Subject to any disclaimer, the term of this patent is extended or adjusted under 35 U.S.C. 154(b) by 0 days.

(21) Appl. No.: 11/418,001

(22) Filed: May 4, 2006

(65) Prior Publication Data

US 2007/0256954 A1 Nov. 8, 2007

(51) Int. Cl.
*B65D 85/32* (2006.01)

(52) U.S. Cl. ..... 206/521.8; 206/521.1; 220/508

(58) Field of Classification Search ..... 206/521.1, 206/521.6–521.9, 509; 220/508
See application file for complete search history.

(56) References Cited

U.S. PATENT DOCUMENTS

| | | | | |
|---|---|---|---|---|
| 2,600,130 | A * | 6/1952 | Schilling | 206/521.8 |
| 2,974,842 | A | 3/1961 | Reifers | |
| 3,319,865 | A * | 5/1967 | Livas | 206/521.1 |
| 3,356,277 | A * | 12/1967 | Hohnjec | 206/521.8 |
| 3,421,682 | A * | 1/1969 | Eisenbach | 206/521.1 |
| 3,447,731 | A * | 6/1969 | Lehmann | 206/521.8 |
| 3,510,049 | A | 5/1970 | Donovan | |
| 3,643,857 | A | 2/1972 | Noguchi | |
| 3,779,370 | A | 12/1973 | Snow et al. | |
| 3,813,027 | A * | 5/1974 | Misdom et al. | 206/521.1 |
| 4,842,143 | A | 6/1989 | McKee, Sr. et al. | |
| 5,102,034 | A | 4/1992 | Amabili | |
| 5,287,979 | A | 2/1994 | Bourgeois | |
| 5,695,062 | A * | 12/1997 | Lemaire | 206/521.8 |
| 5,927,501 | A | 7/1999 | Herbruck | |
| 6,168,021 | B1 | 1/2001 | Herbruck | |
| 2006/0060493 | A1 * | 3/2006 | Marshall | 206/521.1 |

* cited by examiner

*Primary Examiner*—Luan K Bui
(74) *Attorney, Agent, or Firm*—Leon D. Rosen

(57) ABSTRACT

A container (10) that is formed of sheet plastic that has been deformed, includes a base (12) having a plurality of egg-receiving recesses (20) and a cover (14) that can be latched closed on the base. The cover has a plurality of latch parts (30) spaced along each side and has a plurality of outwardly deformed chimney parts between the latch parts, that form chimneys (70) for ventilation of the eggs. Each egg-receiving recess in the base, has inclined ribs (62) that limit sideward egg movement and allow air circulation, has a recess bottom wall (66) for supporting the bottom of an egg, and has an air circulation region (64) lying between the recess bottom wall and rib bottoms for allowing the movement of air around the lower portion of the egg. The outer portion of the ventilation region forms legs (68) that support the container on a flat surface while holding the recess bottom above that flat surface. A tray (16) is used to hold extra eggs and is well supported between the base and cover by columns (46), posts (40, 57) and shafts (50).

10 Claims, 5 Drawing Sheets

14
16
50
56
55
52
54
40
12
46
58
57

30
70
30
70

58
124
72c
122
70
24
32
51
26
30
80
75
77

EGG CONTAINER

BACKGROUND OF THE INVENTION

Egg containers commonly include a base with a plurality of egg-receiving recesses and a cover that closes the recesses. Eggs are usually washed in warm water prior to placement in the recesses and closing of the cover. It is desirable to provide good ventilation for the container to allow the remaining water and any further moisture to evaporate and thereby prolong the life of the eggs. It is also important to provide good support and confinement for the eggs, to prevent the eggs from breaking even if the container is tilted. In some cases, the number of eggs that can be held in a container is increased without greatly increasing the size of the container, by providing a tray with additional egg-receiving recesses and by increasing the height of the base. Such container is likely to be less rugged than one without a tray because of the increased height and weight, so the design should provide additional support and stiffener means for such container. It would be desirable if all of these features were provided in a low cost container formed of sheet plastic such as transparent polyethylene of 0.02 inch thickness which is deformed as by heating and using a vacuum to deform the sheet in the shape of a mold. Such construction would provide durable, protective, attractive and low cost containers for eggs and other rounded pieces of food.

SUMMARY OF THE INVENTION

In accordance with one embodiment of the invention, application provides a low cost and attractive egg container that is formed of transparent sheet plastic that has been deformed, wherein the container provides good ventilation, good protection against egg breakage, and a stiffened and strong structure in a case where a tray is used to hold extra eggs. The container includes chimneys where large volumes of air can flow into and out of the container. The chimneys are formed in sides of the cover, between each of a plurality of cover latch parts that are also spaced along each side of the container. The chimneys are formed by outwardly-deformed locations that have open lower ends lying beyond and below the cover rim.

Each egg-receiving recess in the base has ribs inclined from the vertical to engage an egg and allow air circulation between the ribs. The bottom of the recess forms a bottom wall with a concave upper surface on which a small egg rests. The recess walls form a plurality of leg parts that surround the recess bottom wall and that extend downward to hold the recess bottom wall slightly above a surface that the container lies on, to protect the egg. The inside of the leg parts forms a circulation zone where air passing between the ribs can circulate. The ribs preferably lie on an imaginary ellipsoid, which is the shape of a typical egg.

For increased capacity with only a modest increase in container size, a tray is included that has a plurality of tray egg-receiving recesses and a base of increased height. To counter the reduced rigidity that would arise from this, columns are formed in the base, in the tray, and in the cover to support them on one another.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
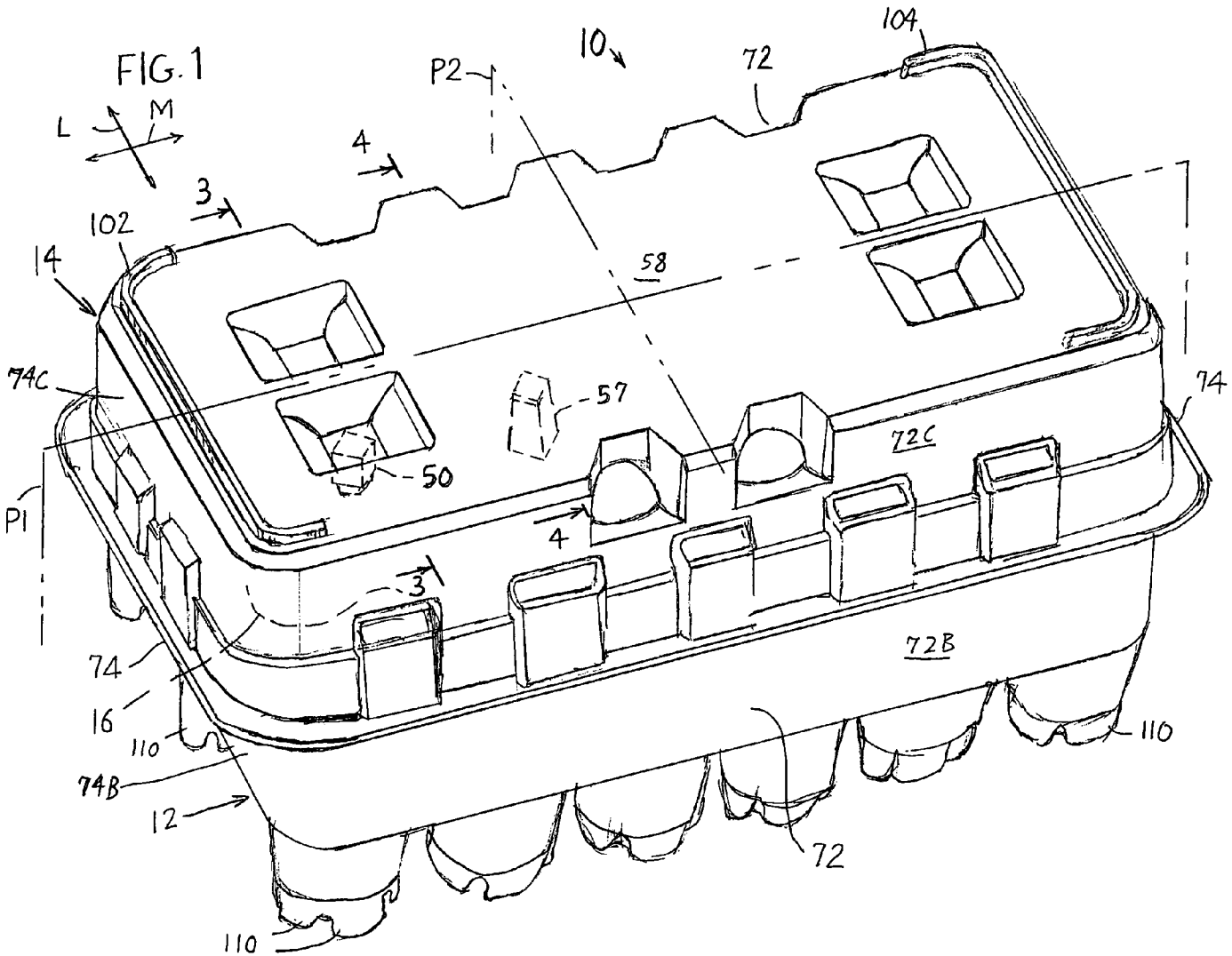
FIG. 1 is a top isometric view of a container of the invention, shown in a closed position.
Figure 2:
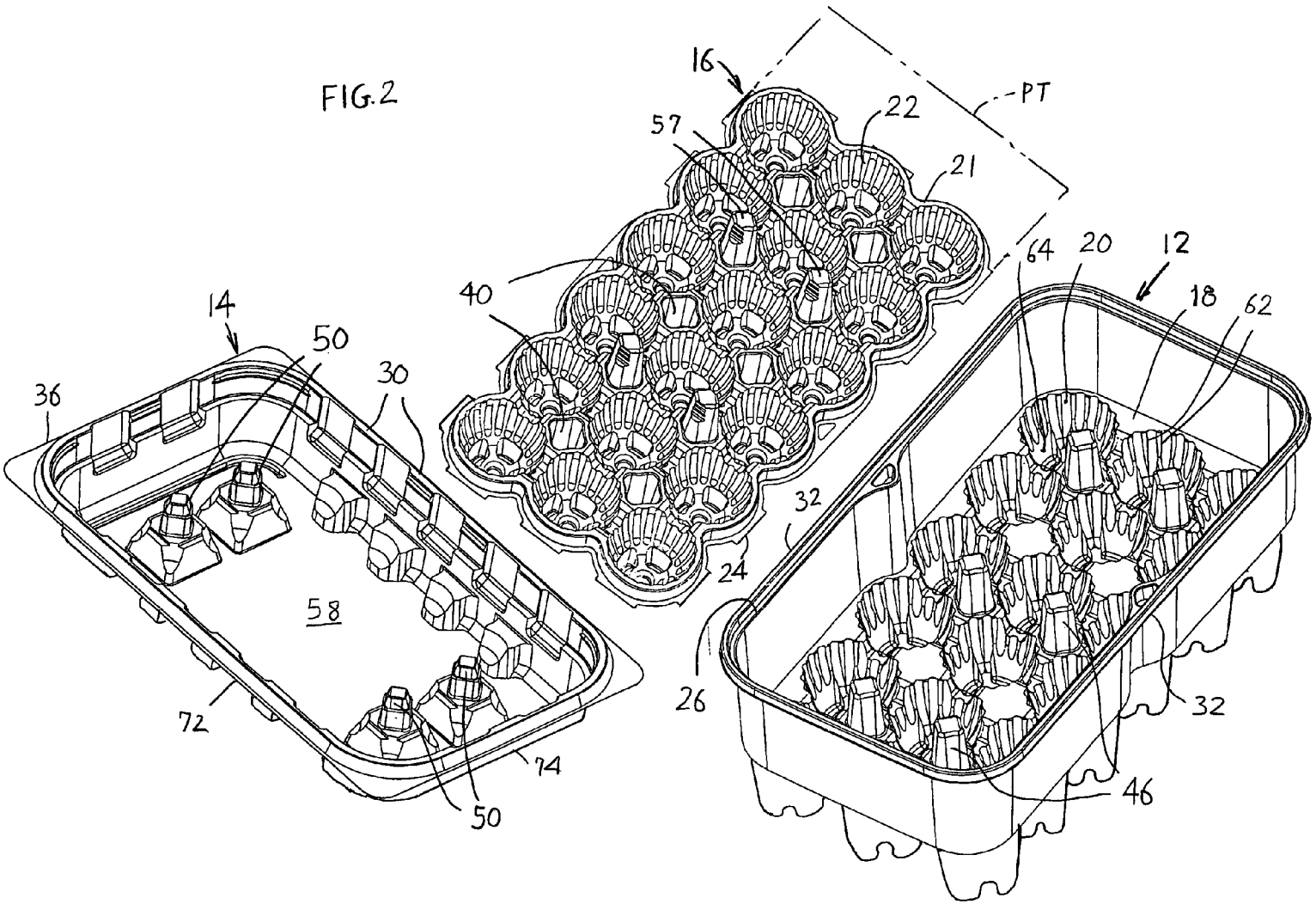
FIG. 2 is an exploded top isometric view of the container of FIG. 1, showing the base, cover and tray thereof.

FIG. 1 shows the assembled container 10, which includes a base 12, a cover 14, and a tray 16. The base holds eighteen eggs and the tray holds another eighteen eggs, so the entire container holds a total of thirty-six eggs in a compact container. Each of the three container parts is formed of a sheet of thin plastic (preferably nonfoam) such as a polyethylene having a thickness of 0.02 inch and which is preferably transparent. The sheet has been deformed into the desired shape as by vacuum-forming. FIG. 2 shows the base, cover and tray in a disassembled configuration. The base has a bottom wall 18 with depressions forming egg-receiving recesses 20. The tray has a top wall 21 defining the plane PT of the tray and the tray has depressions therein that form egg-receiving recesses 22. The base and tray each has eighteen egg-receiving recesses 20, 22 that each can hold the lower half of an egg. The recesses are arranged in six rows and three columns in both the base and tray. The container and its base, cover and tray are each symmetrical about perpendicular vertical planes P1 and P2 (FIG. 1) that extend through laterally-spaced (along arrows L) opposite sides 72 and through longitudinally-spaced (along arrows M) opposite sides 74 of the container. The base has sides 72B, 74B and the cover has sides 72C, 74C.

The container is assembled (usually, after eggs have been placed in some or all of the recesses) by placing the tray 16 on the base 12, with an interrupted peripheral tray edge region 24 (FIG. 2) supported on a narrow continuous support surface 26 near the top of the base edge. Then, the cover 14 is placed over the base and is pressed down with a moderate force such as five pounds, so numerous latch parts 30 on the cover engage a continuous rim 32 that extends around the base. The cover is latched securely enough to the base that the cover will not come off even if the container with a full load of eggs is lifted by the cover rim 36 (so long as the cover is not vigorously shaken). However, the cover can be removed by pulling up the cover rim 36 such as at one corner of the rim, with a moderate force such as 8 pounds while holding down a location on the tall base below the corner, to release all of the cover latch parts 30 from the base rim in rapid succession.

Figure 3:
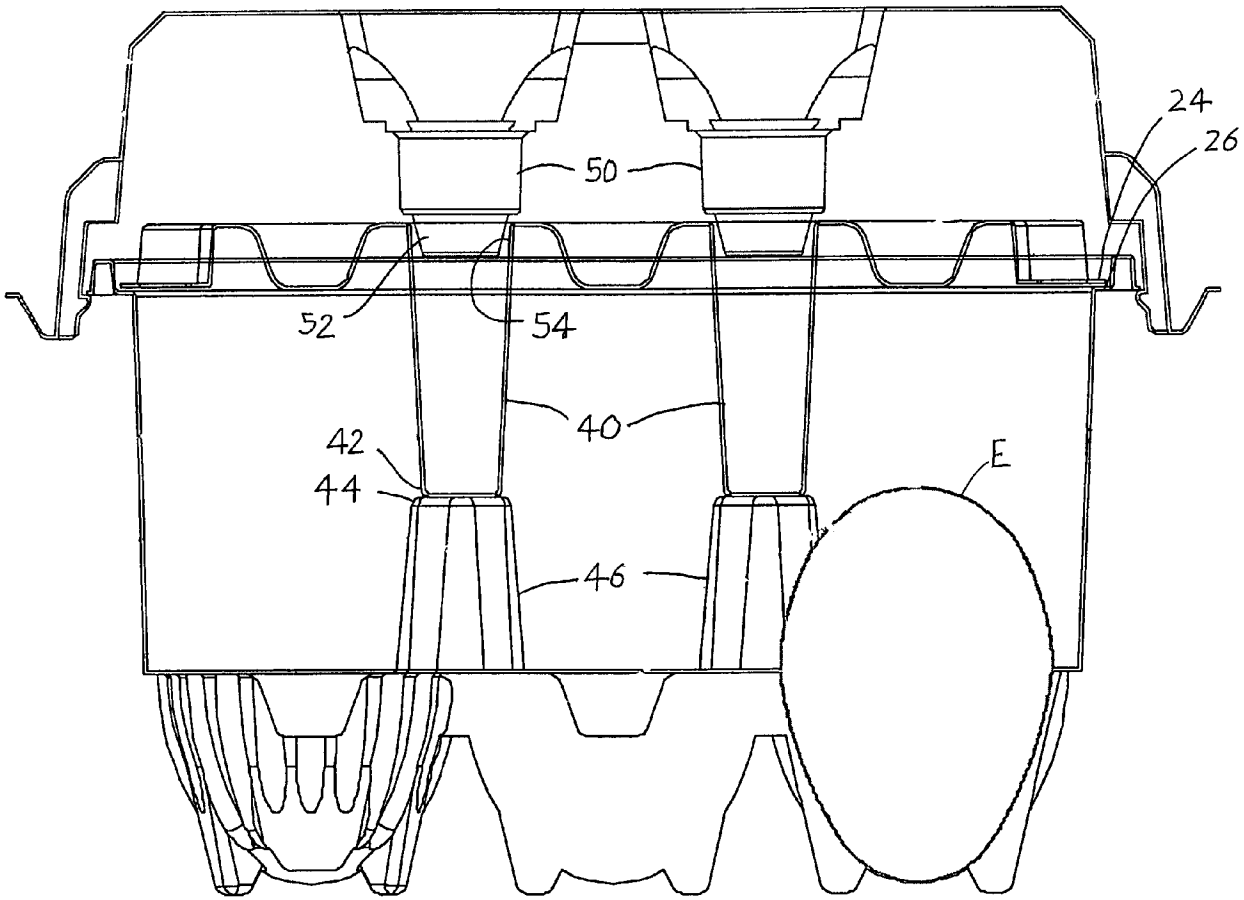
FIG. 3 is a sectional view taken on line 3-3 of FIG. 1.

FIG. 3 shows the peripheral edge region 24 of the tray lying on the narrow support surface 26 at the top of the base. The figure shows downwardly-projecting tray posts 40 formed in the tray. Each downward post has a lower end 42 that can rest on a column top 44 of an upwardly-projecting base column 46 formed in the base. The figure also shows downwardly-projecting cover shafts 50 that each extends down from a shaft base 96 at the top, and that each has a shaft lower end 52 that enters a passage 54 formed at the top of a tray downward post. The posts 40, columns 46, and shafts 50 all result from deformation of plastic sheet material forming the tray, base, or cover.

FIG. 2 shows that the base has six columns 46, the tray has six downward posts 40, and the cover has four shafts 50. The tray peripheral edge region 24 is supported on the base support surface 26 so the post lower ends and the column upper ends initially do not engage one another. However, the downward tray posts and the base columns lie close together (e.g. within one-quarter inch) so if the tray deflects downward or the base deflects upward, the base posts will engage the tray downward posts to limit tray deflection. The cover shafts 50 limit downward movement of the top of the cover when a heavy object is placed on the top of the cover. FIG. 1 shows that there are only four cover shafts 50, and they lie near the opposite longitudinally-spaced sides 74 of the container. This leaves a wide area where the top of the cover is not obstructed so it can be more easily seen through. Applicant constructs the tray with four upstanding posts 57 that abut and support the middle portion of the flat cover top 58 (FIG. 7) on the tray. The downward and upward tray posts, as well as the tray recesses are all formed in a single sheet of deformed plastic.

Figure 4:
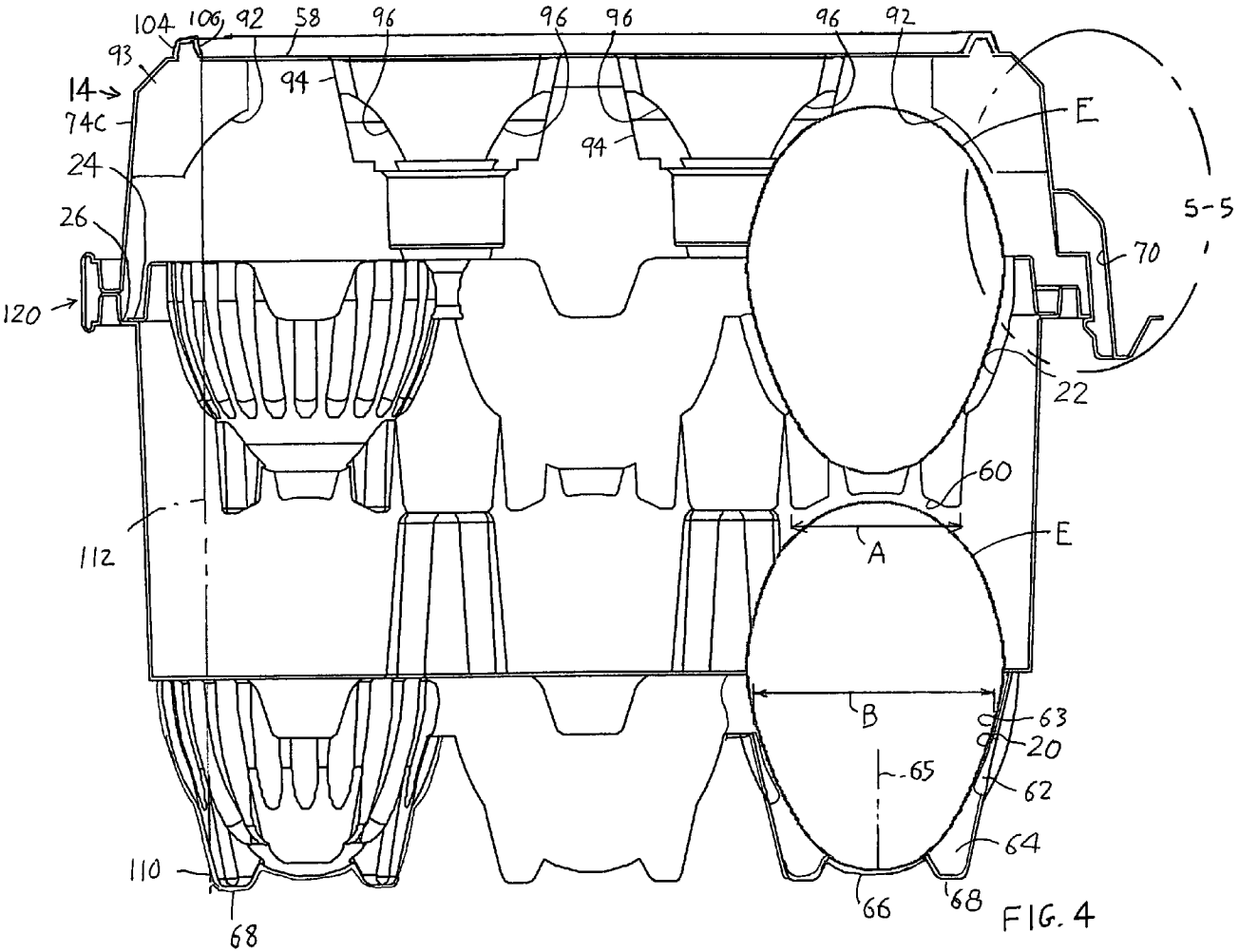
FIG. 4 is a partially sectional view similar to one taken on line 4-4 of FIG. 1, but with the container modified by connecting the base and cover with a hinge.

FIG. 4 shows a container similar to that of FIGS. 1-3 except that the base and cover are formed by a single sheet of plastic and are connected by a hinge 120. FIG. 4 shows two eggs E in recesses 20,22 of the base and of the tray. It can be seen that the bottom of each tray recess forms a downwardly-facing concave entrapping surface 60 that lies close to the top of the egg on the base. The concave surface supports the egg if the container is tilted far (e.g. 90°) towards an upside down position. The wide extent A of the concave surface which is at least half of the diameter B of the recess, allows the tray surface 60 to prevent the egg from falling out of its recess in any direction of container tilt. FIG. 4 also shows that the cover forms top-side cover regions 93 at intersections of the cover side such as 74C and cover top 58. Each cover region has concave side support surfaces 92 and the shaft base 94 has base surfaces 96 at corners of the shaft bases, that help prevent an egg top from tilting longitudinally and from tilting laterally towards the adjacent cover side.

Eggs are usually washed in warm water before they are placed in the container. It is necessary to provide for considerable ventilation to allow all moisture to escape and to thereafter allow the circulation of air around the eggs. Such circulation lengthens the shelf life of the eggs. The presence of ribs 62 in each recess, with rib inner edges 63 that lie closest to the recess vertical axis 65 and that can support the lower half of the eggs, enables air circulation around each egg. The ribs extend along a lower portion of an ellipsoidal surface similar to that of an egg, to provide good support. The base has recess walls that form a bottom wall 66 that supports an egg that is not supported by the ribs. The bottom wall preferably has a concave upper surface of about the same spherical curvature as the bottom of the egg for larger area contact. The recess includes an air circulation region 64 that enables the circulation of air and that forms foot portions 68 that extend slightly below the lower surface of the recess bottom wall 66. The foot portions 68 allow the bottom wall to deflect slightly downward, if necessary, to avoid egg breakage when the container is laid hard on a flat surface.

Figures 5, 6, 7:
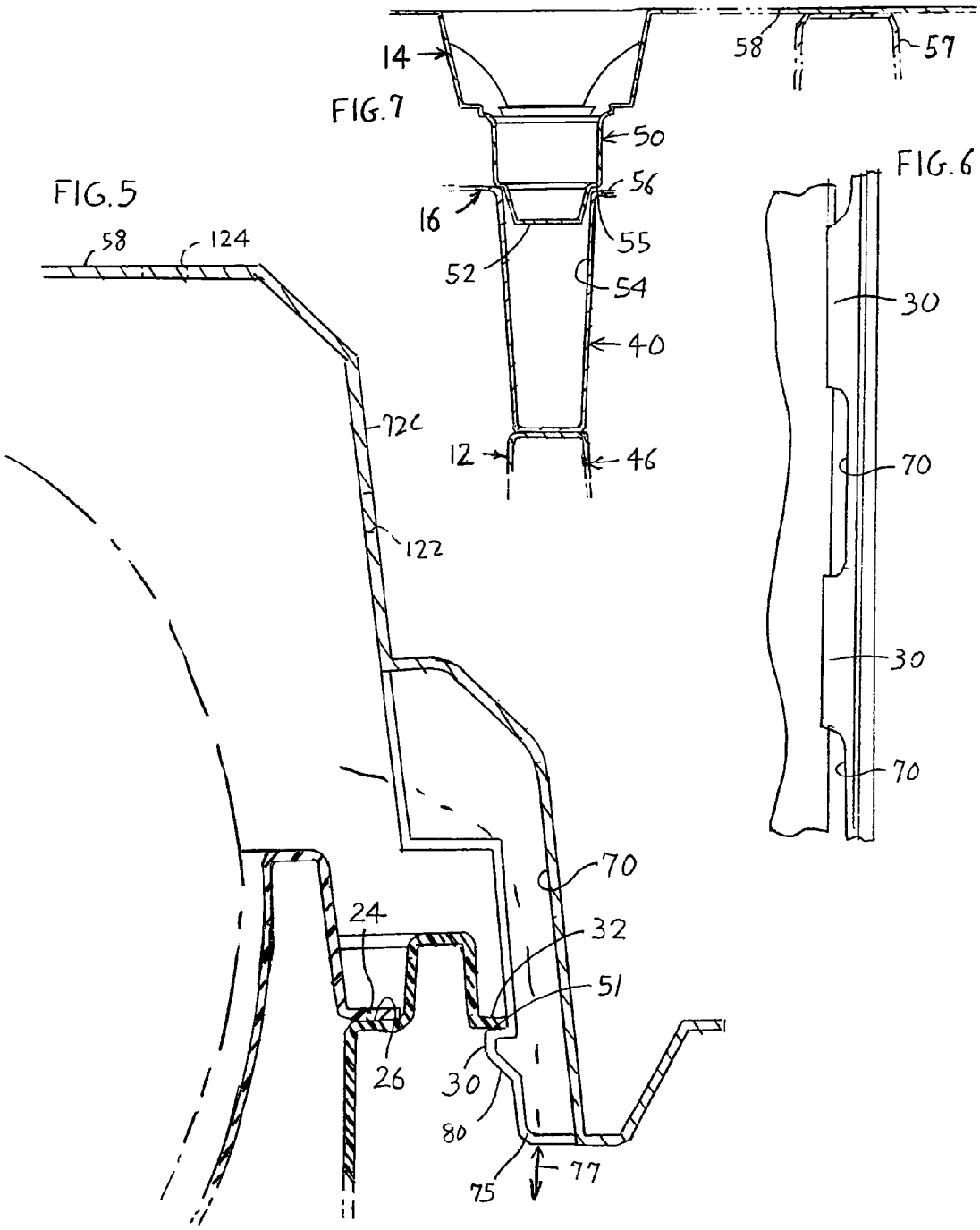
FIG. 5 is an enlarged view of area 5-5 of FIG. 4.
FIG. 6 is a plan view of a portion of a side of the container of FIG. 1.
FIG. 7 is a partial sectional view of a portion of the container of FIG. 1.

The cover 14 forms a number of ventilation chimneys 70 that assure the circulation of air from outside the container through the container. FIG. 5 contains an enlarged view of one of the chimneys 70, and also shows how the tray edge region 24 is supported on the cover support surface 26, and shows how latch parts 30 of the cover can be deflected by its inclined leading surface 80 and then latch under base latch parts formed by the rim 32 of the base. The cover latch parts 30 have upwardly-facing shoulders 51 that lie against a lower surface of the base rim. FIG. 6 shows that the chimneys 70 are spaced apart along the length of each side of the cover by the latch parts 30. FIG. 2 shows that the cover has three or four latch parts 30 at each side 72, one latch part at each corner, and one latch part at each end 74. The spaces between latches form thirteen chimneys. FIG. 5 shows that each chimney has an open bottom 75 that projects beyond the base rim 32, by a distance such as 4 millimeters. Each chimney extends below the base rim 32. Arrows 77 show air flow through the chimney, which can be out of and into the container.

The chimneys 70 open at downward-outward inclines (they could open directly downward), so if food such as orange juice is spilled on the container, such spilled food will not flow through a chimney into the container and soil the eggs. The fact that the chimney opening lies closer to the top of the container than the bottom, results in warm air more easily finding its way into the chimney. It is also possible to place ventilation holes such as those indicated at 122 and 124 in the cover side and top walls.

The cover top wall 58 (FIG. 1) has upstanding ridges 102, 104 formed by upward projections (FIG. 4) in the plastic sheet. The inside 106 of the projections closely (e.g. within ¼" spacing) surrounds the outside 110 of the bottom of the leg portions 68 of the base at the sides and the four corners of the container. An imaginary vertical line 112 shows this alignment. This allow a plurality of containers to be stacked without substantial danger that a container will slide sideways and collapse the stack.

It is possible to construct an egg container without the tray, and it is possible to provide for two or more trays. In many markets the most popular egg containers hold 24 eggs. The container is formed solely of thin plastic sheet material for low cost construction and preferably to allow potential customers to see the eggs.

Thus the container securely holds and protects eggs despite tilting, holds the cover securely closed, securely holds a tray in place while strengthening the container-with-tray, and assures good ventilation of the eggs. The egg-receiving recesses in the base have ridges that allow air to circulate to the bottom of the egg, provide foot portions that support the container slightly above bottom walls of the recesses, and provide ventilation regions in the foot portions. The container-with-tray is strengthened by providing the base with upwardly-extending columns that support the tray, providing the cover with downwardly-projecting shafts that are supported on the tray, and by providing the tray with upwardly-extending posts that support the top of the cover and downwardly-extending posts that lie on the base columns. Although the container is designed to hold eggs, it can hold other pieces of food of largely spherical shapes.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An egg container that includes a base and a cover that are each constructed of a deformed sheet of plastic material, said base having a lower wall that is deformed to form a plurality of egg-receiving recesses, said base and cover each having a periphery including a base rim, a pair of laterally-spaced sides, and a pair of longitudinally-spaced sides, at least one of said sides of said base and cover having latches that are latchable together to keep the container closed until unlatched, wherein:

said cover forms at least one chimney for ventilating the container, said chimney having an upper end that opens to the inside of the container and a chimney lower end that opens to the environment outside the container, and said chimney having an outside wall extending below said base rim and lying below said chimney upper end.

2. The egg container described in claim 1 including:

at least one tray that has a plurality of egg-receiving recesses and that lies between said lower wall and said cover.

3. An egg container that includes a base and a cover that are each constructed of a deformed sheet of plastic material, said base and cover each having a pair of laterally spaced sides and a pair of longitudinally spaced sides, said base being deformed to form a plurality of egg-receiving recesses, wherein:

said egg container includes a tray that lies vertically between a majority of said base and a majority of said cover and that has a plurality of egg-receiving tray recesses, said tray having a plurality of tray supported locations spaced from all of said sides;

said base has a plurality of upwardly-extending base columns with upper ends that engage corresponding ones of said tray supported locations, and said tray has a plurality of primarily vertical first tray columns with upper ends of said columns engaging a flat top wall of said cover.

4. The container described in claim 3 wherein said container has a single tray and wherein:

said tray has a tray plane that lies at upper ends of said tray recesses;

said tray has a second plurality of tray columns that extend downwardly below said tray plane and have lower ends that abut upper ends of said base columns.

5. The container described in claim 4 wherein:

said first tray columns are longitudinally spaced from said second tray columns.

6. The container described in claim 3 wherein said container has a single tray, and wherein:

said tray has a lower surface that forms a plurality of entrapping downwardly-concave surfaces for lying close to the tops of eggs that rest in said egg-receiving recesses of said base to limit movement of said eggs when the container is tilted.

7. An egg container that includes a base and a cover that are each constructed of a deformed sheet of plastic material, said base having a lower wall that is deformed to form a plurality of egg-receiving recesses, said base and cover each having a periphery, a pair of laterally-spaced sides, and a pair of longitudinally-spaced sides, at least one of said sides of said base and cover having latches that are latchable together to keep the container closed until unlatched, wherein:

said cover having a first side with at least one outward bulge forming at least one chimney for ventilating the container, said chimney having an upper end that opens to the inside of the container and a chimney open lower end that opens to the environment outside the container;

said outward bulge of said first side of said cover extends downward beyond the top of the base side.

8. An egg container that includes a base and a cover that are each constructed of a deformed sheet of plastic material, said base having a lower wall that is deformed to form a plurality of egg-receiving recesses, said base and cover each having a periphery, a pair of laterally-spaced sides, and a pair of longitudinally-spaced sides, at least one of said sides of said base and cover having latches that are latchable together to keep the container closed until unlatched, wherein:

said cover has a first side that forms at least one chimney for ventilating the container, said chimney having an upper end that opens to the inside of the container and a chimney lower end that opens to the environment outside the container;

said base has a base rim that forms one of said latches, and the latch of said cover forms a shoulder that lies under and against said rim;

said chimney has a lower end that lies at a level below said base rim.

9. An egg container that includes a base and a cover that are each constructed of a deformed sheet of plastic material, said base having a lower wall that is deformed to form a plurality of egg-receiving recesses, said base and cover each having a periphery, a pair of laterally-spaced sides, and a pair of longitudinally-spaced sides, at least one of said sides of said base and cover having latch parts that are latchable together to keep the container closed until unlatched, wherein:

said cover has a first side with a horizontal length and a plurality of chimneys spaced along said length, at least one of said chimneys having an upper end that opens to the inside of the container and a chimney lower end that opens to the environment outside the container for ventilating the container;

said first cover side has a plurality of said latch parts that lie between said chimneys.

10. An egg container that includes a base and a cover that are each constructed of a deformed sheet of plastic material, said base having a lower wall that is deformed to form a plurality of egg-receiving recesses, said base and cover each having a periphery, a pair of laterally-spaced sides, and a pair of longitudinally-spaced sides, at least one of said sides of said base and cover having latches that are latchable together to keep the container closed until unlatched, wherein:

said cover has a first side that forms at least one chimney for ventilating the container, said chimney having an upper end that opens to the inside of the container and a chimney lower end that opens to the environment outside the container;

said base has a rim portion that extends along one of the base sides and that forms base latch parts;

one of said laterally-spaced sides of said cover extends at a downward-outward incline and forms a plurality of longitudinally-spaced upwardly-facing cover latch shoulders (50) for lying under said base rim portion with said cover side forming an inclined leading surface below each shoulder;

said cover side forms longitudinally spaced outward projections that lie between said cover latch shoulders and that form chimney parts that include said chimney.

* * * * *